United States Patent [19]

Lustvee

[11] Patent Number: 4,625,948

[45] Date of Patent: Dec. 2, 1986

[54] PICKET FENCE

[76] Inventor: Kaljo Lustvee, 18 Finchley Road, Islington, Ontario, Canada, M9A 2X5

[21] Appl. No.: 703,374

[22] Filed: Feb. 20, 1985

[30] Foreign Application Priority Data

Jun. 26, 1984 [CA] Canada ..... 457500

[51] Int. Cl.[4] ..... E04H 17/14

[52] U.S. Cl. ..... 256/72; 256/22

[58] Field of Search ..... 256/22, 21, 65, 72

[56] References Cited

U.S. PATENT DOCUMENTS

| | | | |
|---|---|---|---|
| 30,507 | 10/1860 | Stratton | 256/22 |
| 966,969 | 8/1910 | Webb | 256/72 X |
| 2,766,967 | 10/1956 | Roberts | 256/22 |
| 2,919,112 | 12/1959 | Cofield | 256/22 |
| 3,095,184 | 6/1963 | Boxberger | 256/22 |
| 3,212,754 | 10/1965 | Revell et al. | 256/22 |
| 3,343,326 | 9/1967 | Sickler et al. | 256/22 X |
| 3,411,752 | 11/1968 | Bos | 256/22 |

FOREIGN PATENT DOCUMENTS

| | | | |
|---|---|---|---|
| 29939 | of 1897 | United Kingdom | 256/22 |

*Primary Examiner*—Andrew V. Kundrat

*Attorney, Agent, or Firm*—Rogers, Bereskin & Parr

[57] ABSTRACT

A picket fence construction has a first, transverse rail and a plurality of pickets adapted to be mounted in the rail. The pickets are hung by means of a tongue and engaging link arrangement. The rail includes a tongue for each picket, and each picket includes an engaging link, or the tongue and links are reversed. The pickets are held by retaining means. This can be a second rail which engages the pickets by a tongue and link arrangement operating in the opposite direction. Alternatively the retaining means is a capping rail.

22 Claims, 7 Drawing Figures

PICKET FENCE

This invention relates to a picket fence, and more particularly is concerned with a picket fence formed from sheet steel.

Picket fences have traditionally been made from wood. Whilst wood enables a relatively simple construction to be provided, it has various disadvantages. Wood is subject to rot. Consequently, after erection of the fence, it has to be painted and then painted at regular intervals, to keep the fence in good condition. Also, assembly of a wooden fence is time consuming. Usually, the individual picket and horizontal rails have to be cut to length, and then assembled. If a uniform and neat appearance is to be provided, care has to be taken when cutting the pickets and rails. The fence is then assembled using nails or screws, which is relatively time consuming. Such a construction also cannot readily be disassembled, and then reassembled at an alternative location.

Now various proposals have been made for forming picket fences and the like from steel. U.S. Pat. Nos. 2,766,967 (Roberts), 2,919,112 (Cofield), 3,212,754 (Revell) and 3,411,752 (Bos) disclose fence or like constructions. However, they all disclose relatively complex arrangements that are costly and time consuming to manufacture and install.

The Roberts U.S. Pat. No. 2,766,967 discloses a knock-down fence construction, that incorporates horizontal metal straps with tabs punched out from it. It also has vertical slats, with notches cut in the edges. These notches correspond to the punched tabs, and the slats are bowed, to enable them to engage the tabs. The construction is intended as a lightweight low fence for the edge of flowerbeds and the like. The use of flat horizontal rails and slats that can be bowed does not provide a very rigid construction. Also, the tab and notch arrangement prevents the slats being aligned at anything but a right angle to the horizontal rails. After assembly, there is nothing to permanently secure the slats in position, and consequently they can be accidentally or deliberately removed.

The Cofield U.S. Pat. No. 2,919,112 discloses a collapsible fence arrangement. For this purpose, horizontal stringers and vertical pickets are riveted together, to enable relative rotation between them. The arrangement does not permit ready assembly and disassembly of the fence structure.

The Revell U.S. Pat. No 3,212,754 discloses an interlocking fence structure. A top rail has specially formed slots and tongues, for engaging vertical pickets. The pickets similarly have a complex cross-section and three projections for securing them in the top rail. The overall construction is quite complex, and it is not at all clear that a very secure construction will result.

The Bos U.S. Pat. No. 3,411,752 discloses a guard rail construction, such as a balcony balustrade. Here, generally I-section vertical members are provided. These members are accommodated in corresponding openings of top and bottom horizontal rails. Pins secure the vertical members in the horizontal rails. To cover the tops of the vertical members protruding through the top horizontal rail a sheet form handrail is provided. Here, relatively complex extrusions are required, and numerous components needed to complete the construction.

According to the present invention there is provided a fence construction comprising a first, transverse rail, a plurality of pickets adapted to be mounted on the first transverse rail, each picket including one of a first tongue and a first transverse link for engaging a first tongue, and the first transverse rail being provided with a respective first transverse link or first tongue, for each picket, to enable each picket to be mounted on the transverse rail, and retaining means for retaining the pickets in position on the transverse rail.

Preferably, the first transverse rail is provided with first tongues, which are upwardly directed and each picket includes a first transverse link, to enable the pickets to be hung from the first transverse rail.

The fence construction preferably includes a second transverse rail. Each picket then includes one of a second link or second tongue, corresponding to a respective second tongue or link on the second, transverse rail. The pickets are thus engaged with the second rail. The first and second tongues can be so arranged that the first tongues prevent movement of the pickets in one vertical direction and the second tongues prevent movement in the other direction, thereby forming the retaining means. This can be achieved by first hanging the pickets on the first, transverse rail. The second rail is then engaged with the pickets by a downward movement and secured in position. Preferably, the tongues are provided on the rails and the links are provided on the pickets.

Alternatively, instead of a second transverse rail, a capping rail can be provided, on top of the first horizontal rail. This capping rail abuts, or is adjacent to, the tops of the pickets to prevent upward movement of them. Consequently, the pickets are prevented from becoming disengaged from the transverse rail.

The fence construction of the present invention can be formed from sheet steel, aluminum or other metal by stamping. Consequently, production costs should be low. Assembling even for a fence with a large number of small pickets, can be quick and simple. First, the transverse rail is secured to two or more vertical posts. Then, it is a simple matter to walk along side the transverse rail, and hang the vertical pickets on it. With all the pickets in position, the means for securing the pickets, either the second transverse rail or the capping rail, can be mounted in position. In the case of the capping rail it is in any case desirable to provide a second transverse rail to secure upper ends of the pickets. The fence construction is then complete, except for painting or other finishing operations.

By providing the fence construction in the form of separate elements, which are assembled on site, it is compact and easy to transport.

For a better understanding of the present invention, and to show more clearly how it may be carried into effect, reference will now be made, by way of example, to the accompanying drawings, and which show preferred embodiments of the present invention and in which.

Figure 1:
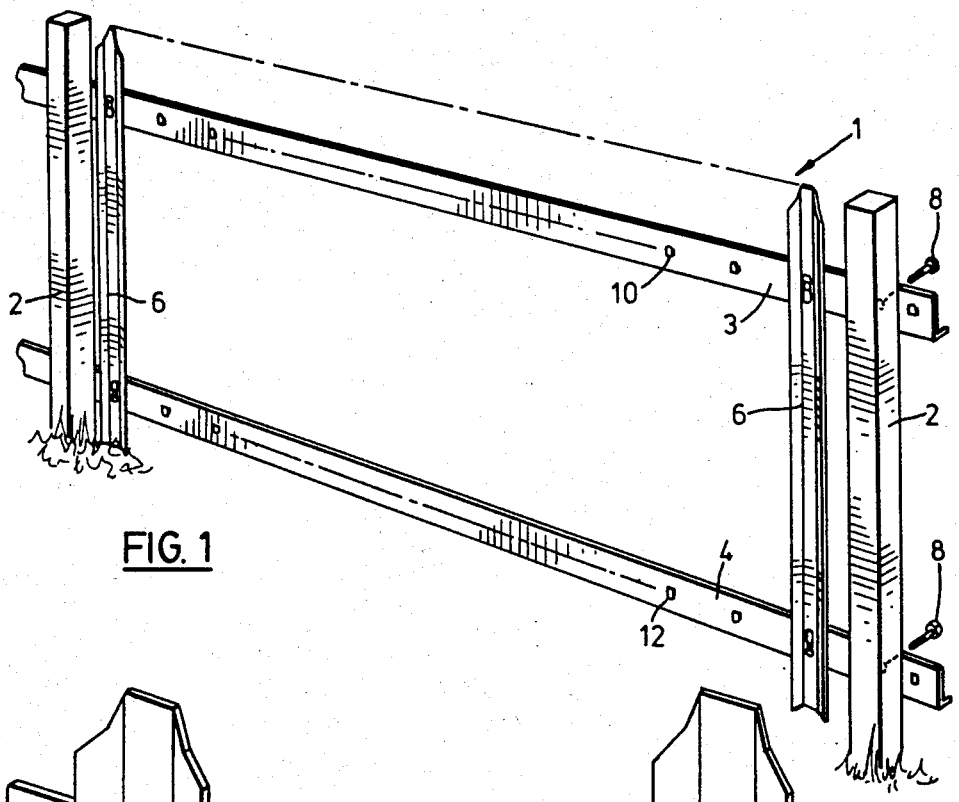
FIG. 1 shows a perspective view of a fence construction according to the present invention.

FIG. 1 shows a fence construction, which is generally indicated by the reference 1. The fence construction includes two vertical posts 2, which can be made from wood, and here are shown to be of square cross-section. Extending between the two vertical posts 2 are a first, top horizontal rail 3 and a second, lower bottom horizontal rail 4. Mounted on the horizontal rails 3,4 are vertical pickets 6

Figure 2:
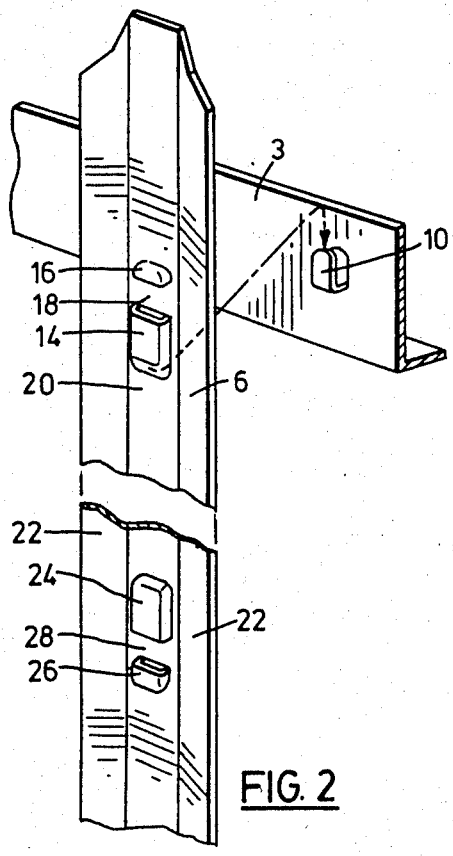
FIG. 2 shows, on an enlarged scale and in a perspective view, a detail of part of a horizontal rail and a picket.

The top and bottom horizontal rails 3, 4 are formed from sheet steel, and have a L-section as shown most clearly in FIG. 2, for the top rail 3. The rails 3, 4 are secured by bolts or screws 8, to the posts 2, as shown in FIG. 1.

Extending along the length of the first, top rail 3 are vertically extending tongues 10, which are pressed from the vertical web of the rail 3. Similar tongues, 12, are punched out of the vertical web of the bottom horizontal rail 4. These tongues 12 face in the opposite direction to the tongues, 10, i.e. they face downwards.

FIG. 2 shows a detail of the end portions of one of the pickets 6, the centre section of the picket 6 being omitted for clarity. Corresponding to the tongues 10 of the top rail 3, the picket 6 includes a first, major pocket 14, and a first, minor pocket 16. These pockets 14, 16 are stamped from a central strip 20 of the picket 6, the picket 6 additionally including two side strips 22 at an oblique angle to the central strip 20. Open ends of the pockets 14, 16 face one another and between the pockets 14, 16 there is left a horizontal or transverse link, 18. As is detailed below, the dimensions of the pockets 14, 16 are such as to correspond to the dimensions of a tongue, 10.

At the bottom end of the picket 6, again in the central strip 20, there are a second major pocket 24 and a second minor pocket 26. A second link 28 is left between the pockets 24, 26. Corresponding to the opposite orientation of the tongues or projections 10, 12, the second, major pocket 24 faces downwards, and towards the second minor pocket 26, which faces upwards.

Figure 3:
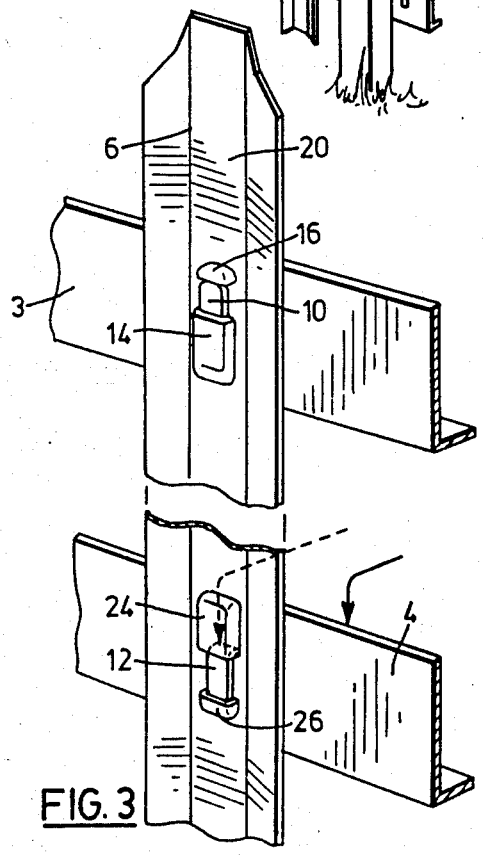
FIG. 3 shows, on an enlarged scale and in a perspective view, the detail of two horizontal rails and a picket.

To assemble the construction of FIGS. 1, 2 and 3, the posts 2 are first inserted into the ground, at desired locations. Then, the top horizontal rail 3 is affixed to the posts 2, by means of bolts or screws 8. The required number of pickets 6 are then hung on the tongues 10 of the rail 3. To permit engagement of each picket 6 with a tongue 10, the length of each major pocket 14 is at least equal to the length of each tongue 10. This permits each tongue 10 to fully enter the major pocket 14. Following this, the picket 6 can be dropped vertically, so that the link 18 falls behind the respective tongue 10. The link 18 has a vertical depth less than the length or depth of the tongue 10. Consequently, the tongue 10 protrudes above the link 18, into the first minor pocket 16. This arrangement, in the engaged configuration, is shown clearly in FIG. 3.

When all the pickets 6 have been hung on the first top rail 3, the second bottom rail 4 can be placed into position. The second rail 4 is brought up against the bottom of the pickets 6, so that all its tongues 12 engage major pockets 24 of the pickets 6. Again, the depth or actual extent of the pockets 24 is greater than the length of the tongues 12 to enable the tongues 12 to fully enter or engage the pockets 24. Once all the tongues 12 have entered or engaged the pockets 24, the rail 4 is dropped downwards so that the tongues 12 engage the horizontal links 28. The links 28, like the links 18, have a width which is less than the length of the tongue 12, so that the tongues 12 extend past them into the minor pockets 26. After engagement of the second bottom rail 4 with the pickets 6, it is similarly bolted to the posts 2 by bolts or screws 8.

The fence construction is then complete. By using tongues and links, the assembly of the fence is greatly simplified and can be achieved quickly. Only four bolts or screws are needed to mount each section of the fence to its respective posts.

The construction has a number of advantages over traditional picket fence constructions. It can be readily dismantled and then re-erected at a different location. The arrangement of tongues, links and pockets can permit a certain amount of relative rotation between the pickets and the rails. Thus, the fence construction can automatically adapt itself to inclines. For an incline, the posts 2 are located as usual, in a vertical position. The top rail 3 is secured to the posts 2 and then the pickets 6 can be hung on the top rail 3, the pickets 6 hanging vertically. The bottom rail 4 can then be engaged and mounted as before. Thus, in the finished construction, the posts 2 and pickets 6 will be vertical, even though the rails 3 and 4 will be transverse and inclined to the horizontal.

To facilitate insertion of the tongues 10, 12, they preferably have tapered or rounded ends, as shown. A tapered facilitates manufacture and enables the pickets to be inclined. Further, the base ends of the tongues 10, 12, remote from the free ends are preferably pressed out of the webs of the rails so as to be closer to the rails than the free ends. They can be spaced from the webs by an amount less than the thickness of the links 18, 28. Then, as the free ends of the tongues 10, 12 are spaced a relatively large distance from their webs, they can still readily engage the links 18, 28. However, the closer spacing of the bases of the tongues 10, 12 enables them to clamp or grip the links 18, 28 against their respective webs. This will prevent the pickets becoming loose or rattling.

The rails 3, 4 and pickets 6 are preferably stamped from a sheet metal, such as steel or aluminum. For aluminum, no finishing treatment is needed. For steel, after assembly, the fence should be painted, although this can be omitted for galvanized steel.

The minor pockets 16, 26 serve to significantly strengthen the structure. Without the minor pocket 16, for example, the tongues 10 would abut the straps 18 and the free ends of the tongues 10 would not be restrained. Then, a force tending to separate the top of the picket 6 from the horizontal rail 3 could bend the tongue 10 towards the horizontal, so that the picket 6 slid off it. However, the pocket 16 holds the top of the tongue 10, so that it cannot bend in this fashion. Each pair of major and minor pockets serves as a supporting part for the respective transverse link. Consequently, failure of this connection, in practice, can only occur by the tongue 10 being pulled out whilst being maintained vertical by the pocket 16. As will be appreciated, such a method of failure requires considerable force.

Figure 4:
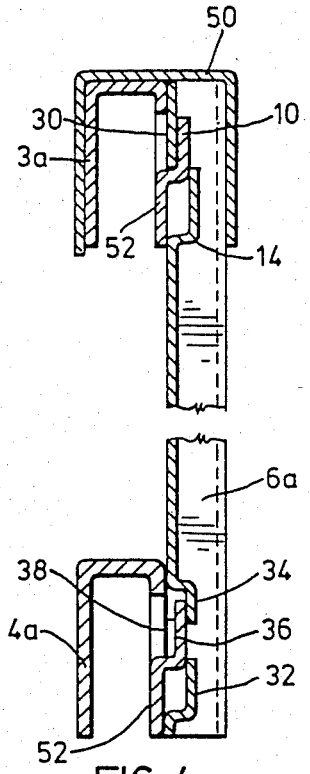
FIG. 4 shows a cross-section through a second embodiment of a fence construction according to the present invention.
Figure 5:
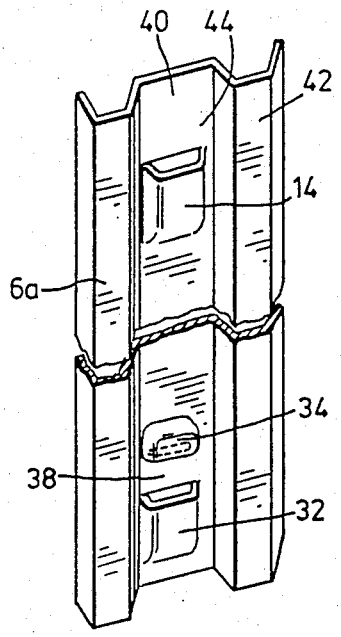
FIG. 5 shows a perspective view of a picket for use in the fence construction of FIG. 4.

Reference will now be made to FIGS. 4 and 5 which show a variant construction of the present invention. In these drawings, parts similar to parts in FIGS. 1, 2 and 3 are given the same reference numeral.

As shown in FIG. 4, this construction includes a top, horizontal rail 3*a* and a bottom horizontal rail, 4*a*. These horizontal rails 3*a* and 4*a* have an inverted U-shape cross-section. Like the horizontal rail 3, the horizontal rail 3*a* includes upwardly directed tongues 10, pressed from a side web of the rail 3*a*. The bottom horizontal rail 4*a* includes tongues 36, which are upwardly directed, like the tongues 10.

As shown most clearly in FIG. 5, a different profile is provided for in each picket 6*a*. Each picket 6*a* includes a flat central strip 40. On either side of the strip 40, there are two trapezoidal channel sections, defined by channel strips 42. Whilst the picket 6*a* is shown with the profile including the trapezoidal channel sections, it could have an overall profile similar to that of the pickets 6 of the construction shown in FIGS. 1, 2 and 3. The picket 6*a* includes the major pocket 14, included in the pickets 6. However, it does not have the minor pockets 16. Instead, a portion 44 of the central strip 40 serves, effectively, as a horizontal link. At its lower end, each picket 6*a* includes an upwardly facing major pocket 32, and a minor pocket 34. Between these two pockets 32, 34 there is a horizontal link 38. Again, the major pockets 14, 32 are sized to correspond to the tongues or projections 10, 36. Also, the rails 3*a*, 4*a* are so positioned as to permit the tongues or projections 10, 36 to enter the major pockets 14, 32 simultaneously.

Thus, in this construction, the horizontal rails 3*a*, 4*a* are secured to posts 2, simultaneously. Then, each picket 6*a* is individually hung on the rails. Each picket 6*a* is simultaneously hung on both rails 3*a*, 4*a*. Thus, the picket 6*a* is brought up against the rails 3*a*, 4*a* so that the tongues 10, 36 enter the pockets 14, 32. It is then dropped or moved downwards so that the tongue 10 engages the portion 44, and the tongue 36 engages the horizontal strap 38. The picket 6*a* is then located in position. As before, the tongues 10, 36 can be so dimensioned and shaped as to securely trap the relevant portions of the picket 6*a*.

It will be appreciated that as both tongues 10, 36 are directed upwards, after mounting of each picket 6*a*, there is nothing to prevent removal of the picket 6*a* by simply pushing it upwards.

To securely retain all the pickets 6*a* in position, a capping rail 50 is provided. This rail 50 has an inverted U-shape cross-section and it encloses the top rail 3*a* and top portions of the pickets 6*a*. Here, the tops of the pickets 6*a* are straight, and flush with the top of the rail 3*a*. The capping or cover rail 50 can be secured by screws or bolts, to the top horizontal rail 3*a*. After it is located, the pickets 6*a* cannot be removed.

This arrangement has the advantage that each picket 6*a* is mounted individually. For the construction of FIGS. 1, 2 and 3, after mounting the pickets 6 on the top rail 3, all the pickets 6 have to be simultaneously engaged with the bottom rail 4 which can be difficult. The construction of FIGS. 4 and 5 can be readily disassembled and reassembled at another location.

The minor pockets are omitted at the top of the pickets 6*a* as the capping rail 50 is provided. This rail 50 can resist any sideways force on the pickets 6*a* so that the minor pockets are no longer required.

The rails 3*a* and 4*a* are so dimensioned as to have portions 52 which cover the pockets 14, 32 in the assembled condition. Whilst not essential from a constructional point of view, this arrangement is preferred as it improves the appearance of the fence. It is also preferred for the construction of FIGS. 1, 2 and 3.

Figure 6:
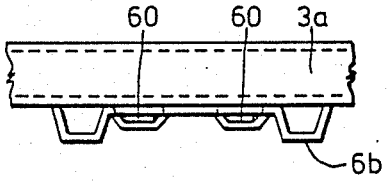
FIG. 6 shows a plan view of part of a rail and an alternative form of picket.

FIG. 6 shows a plan view of a variant picket construction. The picket is denoted by the reference 6*b* and has a width substantially greater than the width of the pickets 6, 6*a*. Again, the picket 6*b* is provided with trapezoidal channel sections at its sides. To accommodate the greater width of the picket 6*b*, at each of the top and bottom of the picket 6*b*, there are two tongue and pocket assemblies denoted by the reference 60. This ensures that each picket 6*b* is securely mounted on the horizontal rails, one of the rails 3*a* being shown in FIG. 6.

Figure 7:
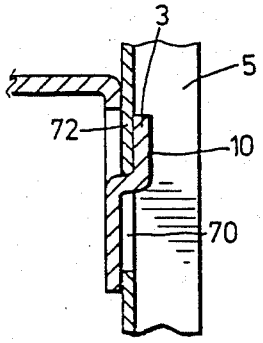
FIG. 7 shows a vertical section through an alternative form of picket and rail.

FIG. 7 shows a cross-section through an alternative form of picket and rail. Here, the rail is denoted 3 and the picket 5. The rail 3 includes tongues 10 as shown in FIG. 1. The picket 5 includes an opening 70, larger than a tongue 10, to permit a tongue 10 to pass through it. Above the opening 70, a portion of the picket bounding the opening 70 serves as a link 72, engaged by the tongue 10. This construction is easier to manufacture. Preferably here the rail 3 is deep enough to cover the openings 70.

Whilst the drawings show tongues 10 with generally parallel sides, the tongues 10 can have tapered sides, to give a pointed profile. This can facilitate punching of the tongues 10.

I claim:

1. A fence construction comprising: a first transverse rail; a plurality of pickets mounted on the first, transverse rail; mounting means mounting the pickets to the transverse rail and comprising; for each picket, a first mounting location which comprises a first, transverse link and a first, supporting part around the first, transverse link, and a first tongue having a length greater than the width of the first transverse link so that a free end of the tongue abuts the supporting part in use, with the transverse rail including one of the first mounting location and the first tongue and the respective picket including the other of the first mounting location and the first tongue, the mounting means further comprising retaining means for retaining the pickets on the transverse rail.

2. A fence construction as claimed in claim 1, wherein the first transverse rail is provided with first tongue, which are upwardly directed and each picket includes a first mounting location, to enable the pickets to be hung from the first transverse rail.

3. A fence construction as claimed in claim 2, wherein each picket includes a first major pocket adjacent its first transverse link, the first major pocket being adapted to receive a first tongue, and a first minor pocket facing its respective first major pocket, with the transverse link extending between the minor and major pockets and being flush with a main part of the picket, the minor pocket being adapted to receive a free end of a respective tongue.

4. A fence construction as claimed in claim 3, wherein the transverse link of each picket is integral with a main portion of the picket.

5. A fence construction as claimed in claim 3, wherein each major pocket has a length greater than the length of the corresponding tongue.

6. A fence construction as claimed in claim 3, 4 or 5, wherein the first transverse rail is so dimensioned that, when the pickets are hung from the first transverse rail, the major pockets of the pickets are covered by the first transverse rail.

7. A fence construction as claimed in claim 1, which includes a second transverse rail, and wherein each picket includes one of a second tongue and a second mounting location which comprises a second, supporting part and a second transverse link of engaging a second tongue and having a width less than the height of the second tongue, and the second transverse rail is provided with one of a respective second mounting location and second tongue for each picket to enable each picket to be mounted to the first and second transverse rails.

8. A fence construction as claimed in claim 2, which includes a second transverse rail which is provided with second tongues, and wherein each picket includes a respective second tongues, and wherein each picket includes a respective second supporting part and a second transverse link for engaging a second tongue with the second tongue having a height greater than the width of the second transverse link, to enable each picket to be mounted on the first and second transverse rails.

9. A fence construction as claimed in claim 8, wherein each picket includes a major pocket adjacent its respective transverse link, the second major pocket being adapted to receive a second tongue.

10. A fence construction as claimed in claim 9, wherein the second transverse rail is so dimensioned that, when the pickets are mounted on the second transverse rail, the second major pockets are covered by the second transverse rail.

11. A fence construction as claimed in claim 9, wherein each second major pocket has a length greater than the length of a second major tongue.

12. A fence construction as claimed in claim 7, wherein the first tongues and first transverse links are so arranged as to prevent movement of the pickets in one vertical direction, and the second tongues and second transverse links are so arranged as to prevent movement of the pickets in the other vertical direction, thereby to form the retaining means for retaining the pickets in position.

13. A fence construction as claimed in claim 8, wherein the first transverse links and the first tongues are so arranged as to prevent movement of the pickets in one vertical direction, and the second tongues and second transverse links, are so arranged as to prevent movement of the pickets in the other vertical direction.

14. A fence construction as claimed in claim 13, wherein the first tongues are directed upwards, and prevent movement of the pickets downwards, and the second tongues are directed downwards, and prevent movement of the pickets upwards.

15. A fence construction as claimed in claim 2, 3 or 14, wherein each of the first transverse rail, the second transverse rail and the pickets is formed from sheet metal.

16. A fence construction as claimed in claim 1, 2 or 8, wherein the retaining means comprises a cover rail adapted to cover the first transverse rail and tops of the pickets, and the first tongues and first transverse straps are arranged to prevent downward movement of the pickets, whereby, with the pickets assembled on the first transverse rail and the cover rail in position, the cover rail prevents removal of the pickets.

17. A fence construction as claimed in claim 8, wherein the first and second tongues are directed upwards, to prevent downward movement of the pickets, and wherein the retaining means comprises a over rail adapted to cover the first transverse rail and tops of the pickets, so that with the pickets hung on the first transverse rail, the cover rail prevents removal of the pickets.

18. A fence as claimed in claim 1, wherein the first tongues have tapered sides, the sides being furthest apart at the base of each tongue.

19. A fence construction as claimed in claim 8, wherein each picket includes: a first major pocket adjacent its first transverse link, the first major pocket being adapted to receive a first tongue, and a first minor pocket facing its respective first major pocket, with the first transverse link extending between the first minor and major pockets and being flush with a main part of the picket, the first minor pocket being adapted to receive a free end of a respective first tongue; and a second major pocket adjacent its respective second transverse link, the second major pocket being adapted to receive a second tongue, and a second minor pocket facing its second major pocket, with the second transverse link extending between the second minor and major pockets and being flush with a main part of the picket, the second minor pocket being adapted to receive a free end of a respective second tongue.

20. A fence construction as claimed in claim 7 or 19, wherein the first tongues and first transverse links are arranged to restrain the pickets from movement downwards, and the second tongues and second transverse links are arranged to restrain the pickets from movement upwards thereby to form the retaining means for retaining the pickets in position.

21. A method of assembling a fence construction as claimed in claim 20, the method comprising the steps of:

(a) after providing support ports, securing the first transverse rail to the support posts with the first tongues directed upwards;

(b) hanging the pickets on the first transverse rail, with the first transverse links engaging the first tongues;

(c) engaging the second tongues of the second transverse rail with the second transverse links;

(d) securing the second transverse rail to the posts to retain the pickets in position.

22. A method of assembling a fence construction as claimed in claim 20, the method comprising the steps of:

(a) after providing support posts, securing the first transverse rail to the support posts;

(b) mounting the pickets on the first transverse rail, with the first transverse links engaging the first tongues;

(c) mounting the cover rail on the first transverse rail and securing the cover rail in position, to retain the pickets.

* * * * *